US006726130B2

(12) United States Patent
Jaubertie

(10) Patent No.: US 6,726,130 B2
(45) Date of Patent: Apr. 27, 2004

(54) NOZZLE INTENDED FOR THE CONCENTRATED DISTRIBUTION OF A FLUID LOADED WITH SOLID PARTICLES, PARTICULARLY WITH A VIEW TO THE FINE, ACCURATE AND CONTROLLED SCOURING OF SURFACES

(75) Inventor: Yvon George Jean Pierre Jaubertie, Paris (FR)

(73) Assignee: Workinter Limited, London (GB)

( * ) Notice: Subject to any disclaimer, the term of this patent is extended or adjusted under 35 U.S.C. 154(b) by 158 days.

(21) Appl. No.: 10/037,342

(22) Filed: Jan. 3, 2002

(65) Prior Publication Data

US 2002/0088881 A1 Jul. 11, 2002

(30) Foreign Application Priority Data

Jan. 4, 2001 (GB) ..... 0100198

(51) Int. Cl.[7] ..... B05B 1/00

(52) U.S. Cl. ..... 239/589; 239/592; 239/597; 239/601

(58) Field of Search ..... 239/589, 592, 239/593, 594, 597, 598, 599, 601, DIG. 8, DIG. 21

(56) References Cited

U.S. PATENT DOCUMENTS 2,296,715 A * 9/1942 Komar ..... 239/592
3,419,220 A * 12/1968 Goodwin et al. ..... 239/591
3,620,457 A * 11/1971 Pearson ..... 239/589
4,813,611 A * 3/1989 Fontana ..... 239/589
5,833,148 A * 11/1998 Steinhilber et al. ..... 239/601
2001/0030250 A1 * 10/2001 Goenka et al. ..... 239/589

* cited by examiner

*Primary Examiner*—Robin O. Evans
(74) *Attorney, Agent, or Firm*—Notaro & Michalos P.C.

(57) ABSTRACT

The invention relates to a nozzle for the projection on to an object of a fluid such as a gaseous flow containing solid particles, comprising a body 1 through which there passes a longitudinal tubular passage, one end of which constitutes an inlet 2 that has to be connected to the intake of a fluid supply conduit and the other end of which constitutes an outlet 3 for the fluid that has passed through the nozzle.

The nozzle is characterized in that the section of the tubular passage is variable between the inlet 2 and the outlet 3, and the passage has three successive portions, which are:

an inlet chamber 11 with a constant section, an intermediate conduit 12 with a variable section, the walls of which are convergent from the chamber 11 to an oblong neck, which has a major axis and a minor axis and the area of which is equal to that of the circular section of the chamber 11, and an outlet tube 14 with a variable oblong section, the walls of which are divergent from the neck to an outlet orifice of oblong section having a major axis and a minor axis.

20 Claims, 3 Drawing Sheets

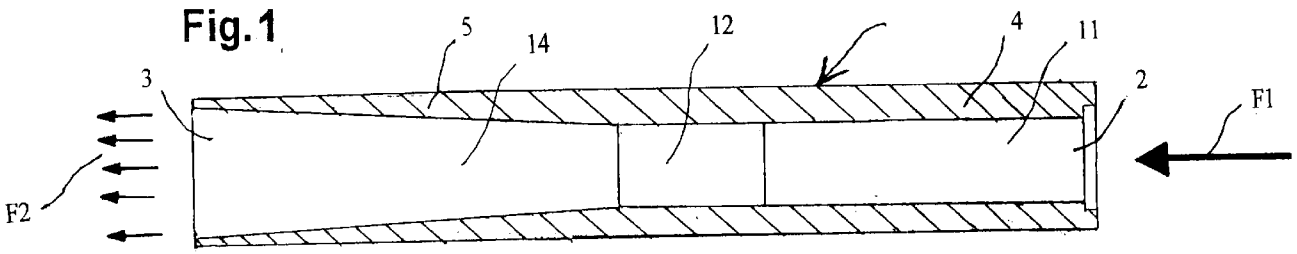
Fig. 1
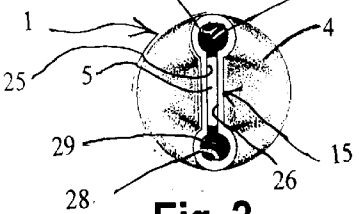
Fig. 2
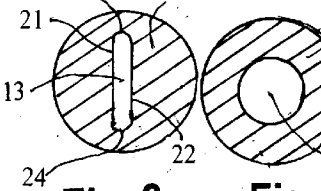
Fig. 3
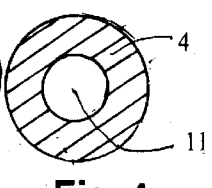
Fig. 4
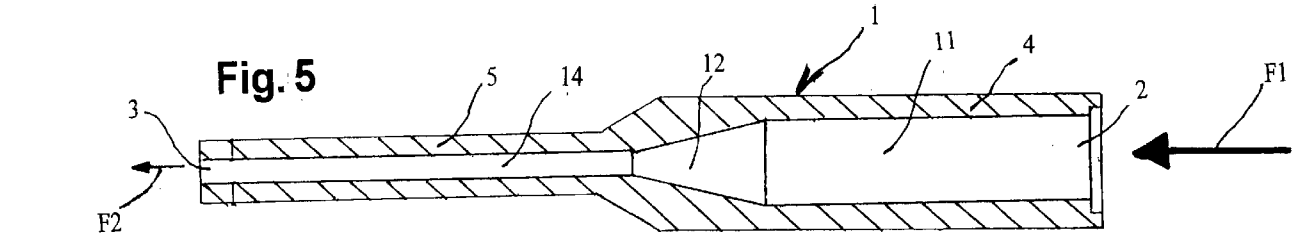
Fig. 5
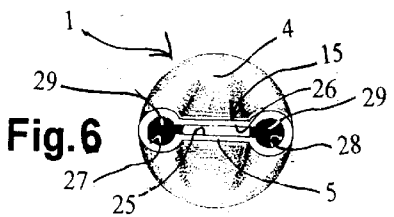
Fig. 6
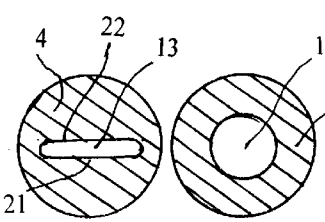
Fig. 7
Fig. 8

F1
2
31
32
4
11
1
12
F3
33
14
5
34
3

11
4
32
31
4
40

4
43
47
32
46
31
44
1
41
5
42
45

F1
2
11
4
31
1
12
14
5

11
4
32
31
4
40

4
45
32
43
47
41
42
1
46
31
44
5

NOZZLE INTENDED FOR THE CONCENTRATED DISTRIBUTION OF A FLUID LOADED WITH SOLID PARTICLES, PARTICULARLY WITH A VIEW TO THE FINE, ACCURATE AND CONTROLLED SCOURING OF SURFACES

The present invention relates to a nozzle intended for the projection on to an object of a fluid, such as a gaseous flow, containing solid particles, particularly with a view to the fine, accurate and controlled scouring of surfaces. There are a multitude of types of surfaces to be scoured, some of which are relatively bulky, and in those cases rustic methods known for many years are sufficient.

Other surfaces, in contrast, require particular care and for these it is unsatisfactory to project irregular or very hard, or very harsh, or very soiling materials.

By way of example, human skin when treated for therapeutic or aesthetic purposes so as to remove the fine outer portion can be cited. The surface of works of art: painted canvas, plans and drawings, manuscripts and parchment, frescoes, sculptures made of wood or mineral materials, when painted or gilded, stained glass windows, porcelain, glazed earthenware, silver and gold plate, etc. together with the facades of buildings, particularly in order to remove deposits, patinas and the marks of time, soiling or graffiti, can also be cited.

A quite different field is the industrial one, where a multitude of cases are to be found requiring scouring, particularly for the purposes of restoration and cleaning.

By way of example, printing cylinders, which have a very finely engraved surface and have very small cells or channels that become loaded with ink and small impurities, require scrupulous cleaning that must both be comprehensive and also leave the printing surface intact.

Mention can also be made of aircraft structures, the bodywork of racing cars and, in general, any fragile or delicate structure that is coated with one or more layers of products that have to be removed subsequently, wholly or layer by layer, the latter condition assuming that it is possible to remove one layer without in any way encroaching on the one immediately below the preceding one.

There is a known projectable medium that lends itself particularly well to the scouring of delicate surfaces, namely a starchy polymer derived from wheat, which forms the subject-matter of U.S. Pat. No. 5,066,335.

This medium is projected with standard nozzles that have the drawback of creating an imprecise outlet flow, so that when carrying out the scouring of a large surface area in successive, juxtaposed parallel strips, each strip has a central zone that is completely scoured and irregular margins that make it necessary to create the adjacent strip by partly overlapping the neighbouring strip created previously. This makes it impossible to guarantee true accuracy since the lateral portion of the supplementary flow of medium can obviously lead to the scouring of missed points but also additional deep scouring of already scoured points, which can result in the lower layer being attacked.

The present invention makes it possible to create a flow of medium without irregular margins, which makes it possible to juxtapose the successive scoured strips in a rigorous manner, without any risk of irregularities and accidental attack of a layer that is to be presented in its complete integrity.

To this end, according to the present invention, there is provided a nozzle for the projection on to an object of a medium formed by fluid such as a gaseous flow containing solid particles, comprising a body through which there passes a longitudinal tubular passage, one end of which constitutes an inlet that has to be connected to the intake of a fluid supply conduit and the other end of which constitutes an outlet for the fluid that has passed through the nozzle, wherein the section of the tubular passage is variable between the inlet and the outlet, and said passage has three successive portions, which are:

an inlet chamber with a constant section, an intermediate conduit with a variable section, the walls of which are convergent from the chamber to an oblong neck, which has a major axis and a minor axis and the area of which is equal to that of the circular section of the chamber, and an outlet tube with a variable oblong section, the walls of which are divergent from the neck to an outlet orifice of oblong section having a major axis and a minor axis.

The invention may include any of the following features:

the inlet chamber has a circular section;

the oblong neck has two rectilinear edges, parallel to its major axis;

the oblong neck has two edges, which are more distant from each other in the central zone than at the sides of the neck;

each of the two edges is formed of at least two rectilinear segments;

the two edges are curved and joined to one another by lateral connecting neck mouldings;

the oblong neck has an elliptical section;

the oblong section of the outlet tube has two rectilinear edges parallel to its major axis;

the oblong section of the outlet tube has two edges, the spacing of which is greater in the central zone than at the sides of the tube;

each of the two edges is formed of at least two rectilinear segments;

the two edges are curved and joined to one another by lateral connecting neck mouldings;

the oblong section of the outlet tube has two edges, the spacing of which is greater at its sides than in its central zone;

the neck having an elliptical section, the oblong section of the outlet tube has two edges with the same curvature as those of the ellipse but of opposite convexity and joined to one another by lateral connecting neck mouldings;

the oblong section of the tube is enlarged laterally by two longitudinal channels;

the inlet chamber contains elements in relief constituting flow concentrators;

the outlet tube is determined by a water-and airtight wall through which there passes at least one passage intended to be connected to a source of gas containing ionised particles and opening out obliquely into said tube, in a downstream direction considering the direction of displacement of the fluid;

the source of gas is associated with a device for mobilisation at high speed;

the device for mobilising the gas is designed so as to impress thereon a speed higher than that of sound;

the gas contains two substantially equal fractions of ionised particles of inverse polarity;

the gas is slightly humid air.

Other characteristics of the invention will become apparent from the following detailed description given with reference to the attached drawing. The invention will now be described by way of example with reference to the accompanying drawings, in which:

FIG. 1 is a diagrammatic view in longitudinal section of a nozzle in accordance with one embodiment of the invention;

FIGS. 2, 3 and 4 are diagrammatic views in cross section of the nozzle in FIG. 1, each positioned in line with the place where it is located;

FIG. 5 is a diagrammatic view in longitudinal section of the same nozzle, at 90° to the section in FIG. 1;

FIGS. 6, 7 and 8 are diagrammatic views in cross section of the nozzle in FIG. 5, each positioned in line with the place where it is located;

Figures 9, 10, 11, 12, 13, 14, 15, 16:
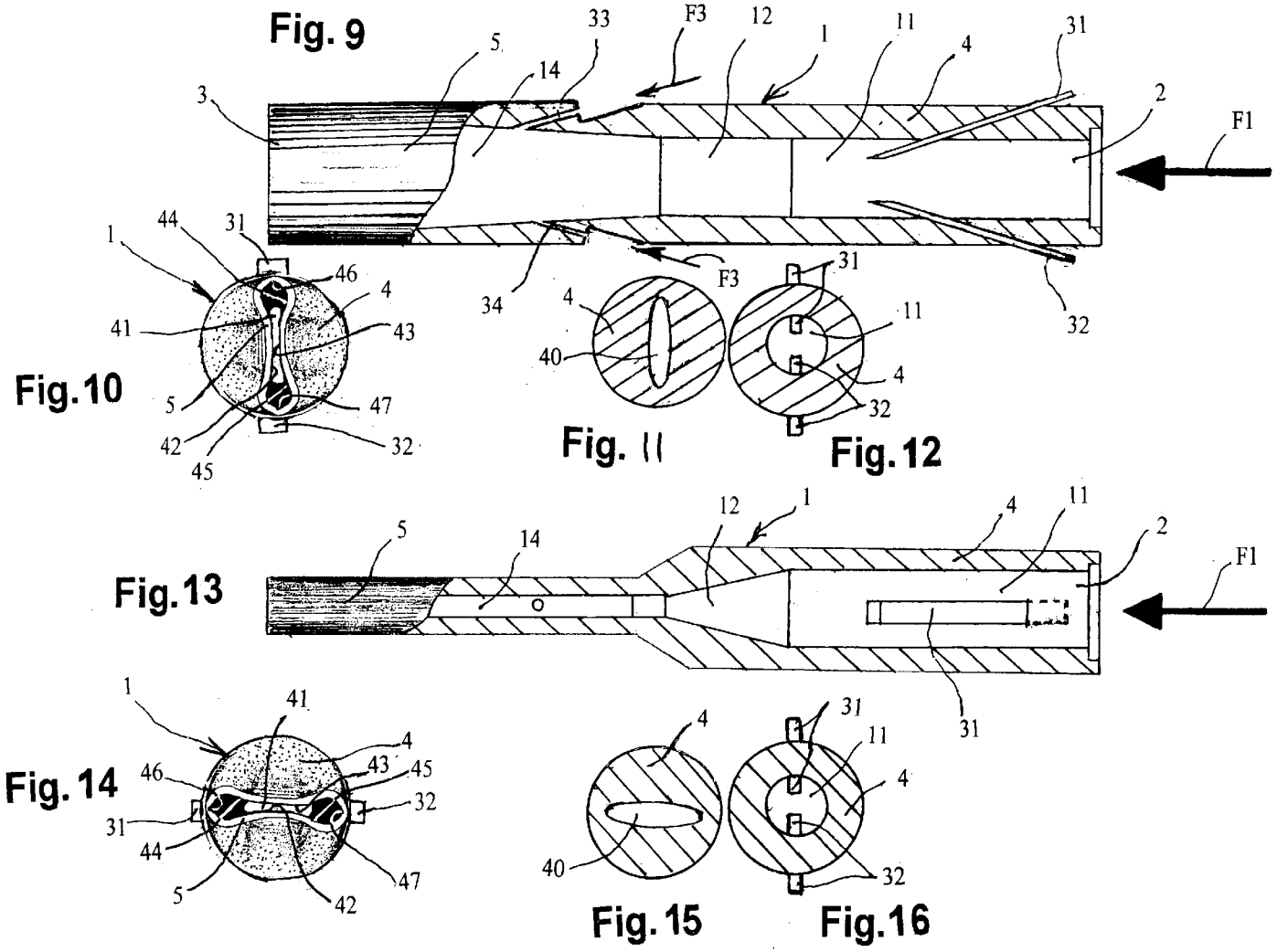
FIG. 9 is a diagrammatic view in longitudinal section of a nozzle in accordance with another embodiment of the invention.
FIGS. 10, 11 and 12 are diagrammatic views in cross section of the nozzle in FIG. 9, each positioned in line with the place where it is located.
FIG. 13 is a diagrammatic view in longitudinal section of the same nozzle, at 90° to the section in FIG. 9.
FIGS. 14, 15 and 16 are diagrammatic views in cross section of the nozzle in FIG. 13, each positioned in line with the place where it is located.

Referring to FIGS. 1 to 8, there is illustrated a nozzle in accordance with an embodiment of the invention illustrated in a single piece. However, it could also be produced by fitting together several sections, particularly in order to facilitate the machining of an axial internal passage, the section of which is variable, as will now be described.

The nozzle is formed of a body 1 through which there passes a longitudinal tubular passage, one end of which constitutes an inlet 2 that has to be connected to a supply conduit (not illustrated) in order to transport a medium to the inlet 2 in the direction of the arrow F1, which medium is composed of solid particles in a gaseous environment, in particular air.

At the other end of the body 1 there is an outlet 3 through which the medium is projected in the direction of the arrows F2 on to a surface in order to scour it of one or more layers that it carries.

The section of the passage between the inlet 2 and the outlet 3 is variable, and the body 1 is formed externally of two segments, which are a cylindrical segment 4 starting from the inlet 2 and a flattened spout 5 connected to the cylindrical segment 4.

Internally, the passage 1 has three portions, which are, in succession: an inlet chamber 11 with a constant circular section over the whole length of said chamber 11, an intermediate conduit 12 with continuously variable section, its walls being convergent from the chamber 11 to an oblong-shaped neck 13, therefore having a minor axis and a major axis, but the area of which is equal to that of the chamber 11, and finally an outlet tube 14 with an oblong section with a continuously variable section, its walls being divergent from the neck 13 to the outlet 3, constituted by the end of the spout 5, and forming an outlet orifice 15 that has an oblong section different in shape from that of the neck 13, the shapes of the neck 13 and the outlet orifice 15 both being coordinated so that, while having equal areas, the flow of medium is projected homogeneously and precisely, without undergoing stray wall effects, which are the cause of irregular margins.

FIG. 3 shows that the oblong section of the neck 13 is very simple in shape, since it has two parallel rectilinear edges 21 and 22 connected by neck mouldings 23 and 24. The distance between the rectilinear edges 21 and 22 is constant and the flow of medium is uniformly flat.

As a result the rate and speed of the flow must in theory be constant over the whole flow section, whereas in reality this is not the case because of the wall effects, which slow down the peripheral particles relative to the speed of the particles located in the central zone, which proves very unfavourable to the obtaining of scoured strips with clear edges.

In accordance with the invention, the flow section of the outlet orifice 15 is co-ordinated with that of the neck 13 in order to rectify this defect.

FIG. 2 shows that the flow section of the orifice 15 has a central portion with two parallel rectilinear edges 25 and 26 connected not by neck mouldings but by arcs of a circle 27 and 28 of greater diameter, creating two longitudinal lateral channels 29.

The spacing between the rectilinear edges 25 and 26 is smaller than that of edges 21 and 22, the total area of the two channels 29 being correlatively greater so that the overall flow section of the outlet orifice has an area equal to that of the neck 13.

The equality of the flow sections of the chamber 11, the neck 13 and the outlet orifice 15 guarantees a constant flow rate between the inlet 2 and the outlet 3 but the different shapes, which the central passage has between the outlet from the chamber 11 as far as the orifice 15, give the medium a diphase flow by homogeneous energy over the whole flow section thanks to a rational distribution of the shapes compensating the wall effects and making the flow homogeneous.

The result is uniform scouring over the whole width of the expelled flow, without creating irregular margins, by forming strips with clear edges that can be very exactly juxtaposed on successive passes, so that the scouring is rigorously constant over surfaces that are as large as they can be, even though this is obtained by a succession of narrow strips.

The outlet jet is in the shape of a flattened brush, in which the energy is also distributed, whether the nozzle is actuated manually or mechanically by a slaved device.

Referring now to FIGS. 9 to 16, they show another embodiment of the nozzle according to the invention. In these figures, the same elements have the same references as in FIGS. 1 to 8.

In the chamber 11 there are two oblique plungers 31 and 32, which "disturb" the random inlet flow so as to homogenise it and concentrate it in order to prepare it for entering the oblong-section neck.

Furthermore, the solid particles of flow are charged with static electricity because of their friction against the walls of the supply conduit and against the walls of the nozzle, which is very inconvenient since the particles are attracted by the surface during scouring and part of them remain stuck there, which means it is necessary to carry out a finishing process consisting in cleaning the scoured surface, a meticulous, tedious and lengthy job.

According to the invention, this drawback is remedied by providing oblique passages 33 and 34, which pass through the wall of the spout 5 and to which conduits (not shown) are connected, coming from a source of ionised air.

This air is compressed and injected at high—even supersonic—speed in the direction of the arrows F3, into the medium circulating in the spout 5.

A pipe (not shown) supplies the air conduits and contains a known type of crown (not shown) producing electrical discharges in the air that cause it to be ionised so that it contains as many negative ions as positive ions.

The air flowing in this pipe is advantageously conditioned so as to be slightly humid.

Those ions that have the same polarity as the surface to be scoured neutralise the particles of medium of inverse polarity that attracted them, so that these particles no longer remain stuck to the surface to be scoured. The particles of medium having the same polarity as that of the surface to be scoured obviously cannot adhere there since like polarities repel each other.

The ions of opposite polarity from that of the surface to be scoured are discarded on the ground.

It should be noted that the nozzle in accordance with the invention, equipped with ionised air injectors, gives greater safety in use since the introduction of this air cannot cause any electrical discharge and therefore does not create conditions entailing a risk of inflammation of the medium since no difference of potential is created, therefore no electrical current exists and there is no rise in potential of the surfaces to be scoured.

In order to carry out the scouring of a surface, the nozzle is displaced in translation in the direction of its longitudinal axis, at a distance and at a pitch angle that depend on the substrate to be removed and the result sought.

In FIGS. 9 to 16, the intermediate conduit 12 is opened out into a neck 40, the oblong flow section of which is elliptical.

In accordance with the explanations given above, the section of the outlet orifice has to have dimensions and a shape that are coordinated with those of the neck 40, and FIGS. 10 and 14 show that the outlet orifice 41 has a flow section with a shape that could be defined as a "counter-ellipse", i.e. the flow section of the orifice 41 is constituted by two curved longitudinal edges 42 and 43 with opposite convexity and connected by broadened curves 44 and 45, which create longitudinal lateral channels 29, so that the central portion of the orifice 41 is narrower than the side portions, it being remembered that the total area of the orifice 41 is equal to that of the neck 40.

Here, the curves 44 and 45 do not connect the edges 42 and 43 continuously, in an arc of a circle for instance, but are in the shape of a broken arc and create, where they intersect, a ridge 46 and 47 respectively, which creates a precise limit to the edges of the flow of medium leaving through the orifice 3.

The conjugated forms of the neck 40 and the outlet orifice 3 make it possible also to distribute the energy of the flow uniformly, by giving priority to the speed of the particles in the central zone of the spout 5 and the flow rate on its two small sides.

This principle can be respected while modifying the shapes in FIGS. 6 and 7 on the one hand and 14 and 15 on the other hand.

This is shown diagrammatically in FIGS. 17 to 22.

Figure 17:
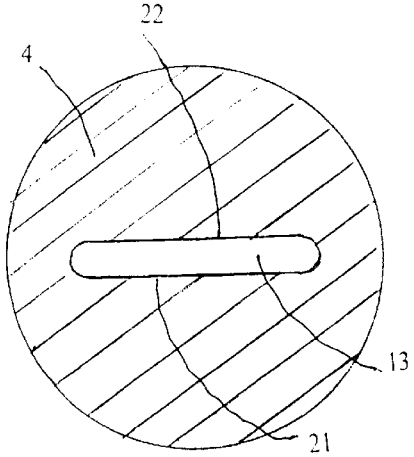
FIGS. 17, 19 and 21 show, in cross section of the nozzle, three variant forms of the oblong neck.
Figure 18:
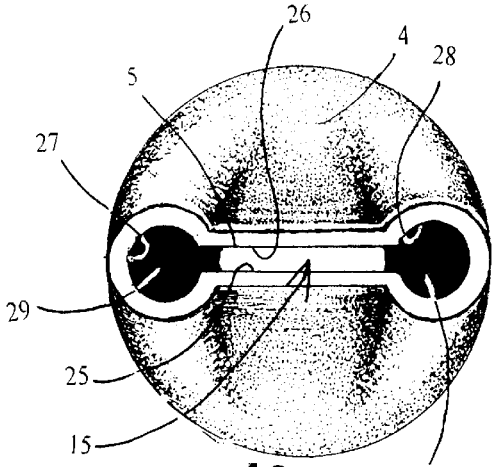
FIGS. 18, 20 and 22 show three variant forms of the outlet orifice each corresponding to the shape of the oblong neck shown opposite, i.e. neck in FIG. 17 and outlet orifice in FIG. 18, neck in FIG. 19 and outlet orifice in FIG. 20, neck in FIG. 21 and outlet orifice in FIG. 22.

The neck 13 in FIG. 17 is the one described with the first embodiment in FIGS. 1 to 8. With regard to FIG. 17, it can be seen that the outlet orifice 15 co-ordinated with the neck 13 is the one also described with the first embodiment in FIGS. 1 to 8.

Figure 19:
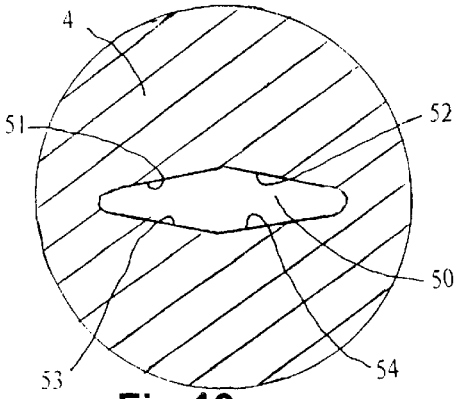
Figure 20:
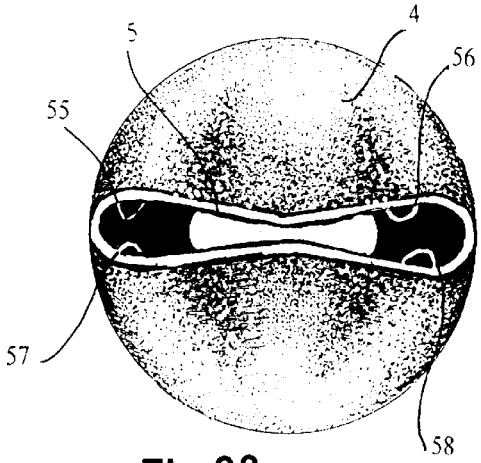

FIG. 19 shows an oblong neck 50 that also has rectilinear edges, as in FIG. 17, but each of them is formed by two segments 51–52 and 53–54 angularly offset so as to have a variable spacing, from a minimum at the sides to a maximum in the central zone. FIG. 19 shows an outlet orifice of inverse shape, i.e. it has two rectilinear edges each formed of two segments 55–56 and 57–58 angularly offset in an inverse manner to the segments 51–52 and 53–54, which have a variable spacing, from a maximum at the sides to a minimum in the central zone.

Figure 21:
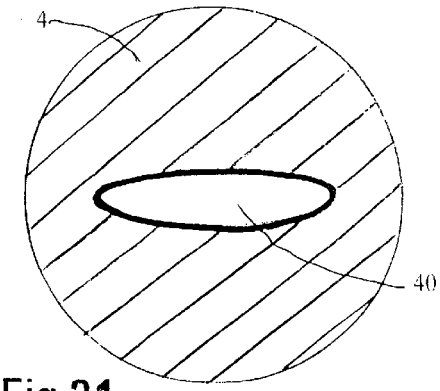
Figure 22:
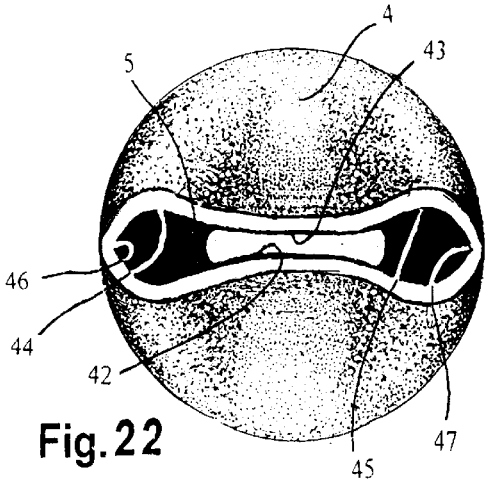

Finally, to allow a better comparison by looking at the views together, FIG. 21 shows the neck 40 in FIG. 15 and FIG. 22 shows the outlet orifice in FIG. 14.

It can thus be seen that the neck can have different shapes, from that in FIG. 17 with parallel rectilinear edges, to the perfectly geometric elliptical shape in FIG. 21.

Since the outlet orifices have a shape coordinated with that of the corresponding neck, this shape can also be produced in different variants, it being remembered that the area of the flow section of the outlet orifice should be equal to that of the neck.

What is claimed is:

1. Nozzle for the projection on to an object of a fluid such as a gaseous flow containing solid particles, comprising a body through which there passes a longitudinal tubular passage, one end of which constitutes an inlet that has to be connected to the intake of a fluid supply conduit and the other end of which constitutes an outlet for the fluid that has passed through the nozzle, wherein the section of the tubular passage is variable between the inlet and the outlet (3), and said passage has three successive portions, which are:

an inlet chamber with a constant section, an intermediate conduit with a variable section, the walls of which are convergent from the chamber to an oblong neck, which has a major axis and a minor axis and the area of which is equal to that of the circular section of the chamber, and an outlet tube with a variable oblong section, the walls of which are divergent from the neck to an outlet orifice of oblong section having a major axis and a minor axis.

2. Nozzle according to claim 1, wherein the inlet chamber has a circular section.

3. Nozzle according to claim 1 wherein the oblong neck has two rectilinear edges parallel to its major axis.

4. Nozzle according to claim 1 wherein the oblong neck has two edges, the spacing of which is greater in the central zone than at the sides of the neck.

5. Nozzle according to claim 4, wherein each of the two edges is formed of at least two rectilinear segments.

6. Nozzle according to claim 4, wherein the two edges are curved and joined to one another by lateral connecting neck mouldings.

7. Nozzle according to claim 6, wherein the oblong neck has an elliptical section.

8. Nozzle according to claim 1 wherein the oblong section of the outlet tube has two rectilinear edges parallel to its major axis.

9. Nozzle according to claim 1 wherein the oblong section of the outlet tube has two edges, the spacing of which is greater in the central zone than at the sides of the tube.

10. Nozzle according to claim 9, wherein each of the two edges is formed of at least two rectilinear segments.

11. Nozzle according to claim 9, wherein the two edges are curved and joined to one another by lateral connecting neck mouldings.

12. Nozzle according to claim 1 wherein the oblong section of the outlet tube has two edges, the spacing of which is greater at its sides than in its central zone.

13. Nozzle according to claim 12, wherein the neck has an elliptical section, and the oblong section of the outlet tube has two edges with the same curvature as those of the ellipse but of opposite convexity and joined to one another by lateral connecting neck mouldings.

14. Nozzle according to claim 1, wherein the oblong section of the tube is widened laterally by two longitudinal channels.

15. Nozzle according to claim 1 wherein the inlet chamber contains elements in relief constituting flow concentrators.

16. Nozzle according to claim 1 wherein the outlet tube is determined by a water- and airtight wall through which there passes at least one passage intended to be connected to a source of gas containing ionised particles and opening out obliquely into said tube, in a downstream direction considering the direction of displacement of the fluid.

17. Nozzle according to claim 16, wherein the source of gas is associated with a device for mobilisation at high speed.

18. Nozzle according to claim 17, wherein the device for mobilising the gas is designed so as to impress thereon a speed higher than that of sound.

19. Nozzle according to claim 16, wherein the gas contains two substantially equal fractions of ionised particles of inverse polarity.

20. Nozzle according to claim 16, wherein the gas is slightly humid air.

* * * * *